US011840078B2

(12) United States Patent
Sato

(10) Patent No.: US 11,840,078 B2
(45) Date of Patent: Dec. 12, 2023

(54) RECORDING APPARATUS AND METHOD OF CONTROLLING THE SAME

(71) Applicant: CANON KABUSHIKI KAISHA, Tokyo (JP)

(72) Inventor: Takaya Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/524,664

(22) Filed: Nov. 11, 2021

(65) Prior Publication Data

US 2022/0161553 A1 May 26, 2022

(30) Foreign Application Priority Data

Nov. 20, 2020 (JP) ..... 2020-193823

(51) Int. Cl.
*B41J 2/045* (2006.01)
*B41J 2/19* (2006.01)

(52) U.S. Cl.
CPC ..... *B41J 2/04563* (2013.01); *B41J 2/19* (2013.01)

(58) Field of Classification Search
CPC ... B41J 2/19; B41J 2/18; B41J 2/17596; B41J 2/175; B41J 2/04563; B41J 2/17566; B41J 29/38; B41J 2202/07
See application file for complete search history.

(56) References Cited

U.S. PATENT DOCUMENTS

2009/0179937 A1* 7/2009 Yamada ..... B41J 29/377 347/17
2018/0154651 A1 6/2018 Ueda
2020/0298581 A1 9/2020 Hara

FOREIGN PATENT DOCUMENTS

| | | | |
|---|---|---|---|
| EP | 1714788 | A1 | 10/2006 |
| EP | 2127883 | A1 | 12/2009 |
| JP | 2006297902 | A | 11/2006 |
| JP | 2012135925 | A | 7/2012 |
| JP | 2014065241 | A | 4/2014 |
| WO | 2017094518 | A1 | 6/2017 |

* cited by examiner

*Primary Examiner* — Jannelle M Lebron
(74) *Attorney, Agent, or Firm* — Canon U.S.A., Inc. I.P. Division

(57) ABSTRACT

A recording apparatus includes a storage unit, a supply flow path, a degassing unit, and a temperature adjustment unit. The storage unit stores liquid that is supplied to a recording head that discharges the liquid. The supply flow path connects the storage unit and the recording head. The degassing unit degases the liquid flowing in the supply flow path. The temperature adjustment unit is positioned between the storage unit and the degassing unit and adjusts a temperature of the liquid flowing in the supply flow path.

11 Claims, 9 Drawing Sheets

RECORDING APPARATUS AND METHOD OF CONTROLLING THE SAME

BACKGROUND

Field

The present disclosure relates to a recording apparatus that records images and a method of controlling the recording apparatus.

Description of the Related Art

Among conventional recording apparatuses that carry out recording with liquid discharged from a recording head, some of them include a configuration that circulates ink between a discharge unit of the recording head and a tank storing the ink therein. Then, if gas dissolved in the ink becomes bubbles and, further, these bubbles grow inside a flow path or the recording head, this causes clogging at the ink discharge unit, thereby resulting in a deterioration in the discharge performance and an occurrence of image defects. For the purpose of reducing the dissolved gas in the ink, there are known techniques that degas the ink.

Japanese Patent Application Laid-Open No. 2012-135925 discusses a liquid droplet discharging apparatus in which a degassing module and an ink temperature adjuster are connected in order on a path extending from a buffer tank to an inkjet head.

However, the configuration discussed in Japanese Patent Application Laid-Open No. 2012-135925 cools the ink by the ink temperature adjuster after the degassing, thereby raising the possibility that the dissolved gas will be dissolved again in the liquid in which the amount of saturated dissolved gas has increased due to the reduction in the temperature.

SUMMARY

The present disclosure is directed to providing a recording apparatus that prevents gas from being dissolved again in liquid after degassing.

According to an aspect of the present disclosure, a recording apparatus includes a storage unit configured to store liquid to be supplied to a recording head configured to discharge the liquid, a supply flow path connecting the storage unit and the recording head, a degassing unit configured to degas the liquid flowing in the supply flow path, and a temperature adjustment unit positioned between the storage unit and the degassing unit and configured to adjust a temperature of the liquid flowing in the supply flow path.

Further features of the present disclosure will become apparent from the following description of exemplary embodiments with reference to the attached drawings.

DESCRIPTION OF THE EMBODIMENTS

In the following description, an exemplary embodiment of the present disclosure will be described with reference to the drawings. However, the exemplary embodiment that will be described below is not intended to limit the present disclosure, and, further, not all of combinations of features that will be described in the present exemplary embodiment are used in the solution of the present disclosure. Further, the relative layouts, shapes, and the like of components that will be described in the exemplary embodiment are cited as examples, and are not intended to limit the scope of the present disclosure to them. In each of the drawings, arrows X and Y indicate horizontal directions perpendicular to each other, and an arrow Z indicates a vertical direction.

<Recording System>

Figure 1:
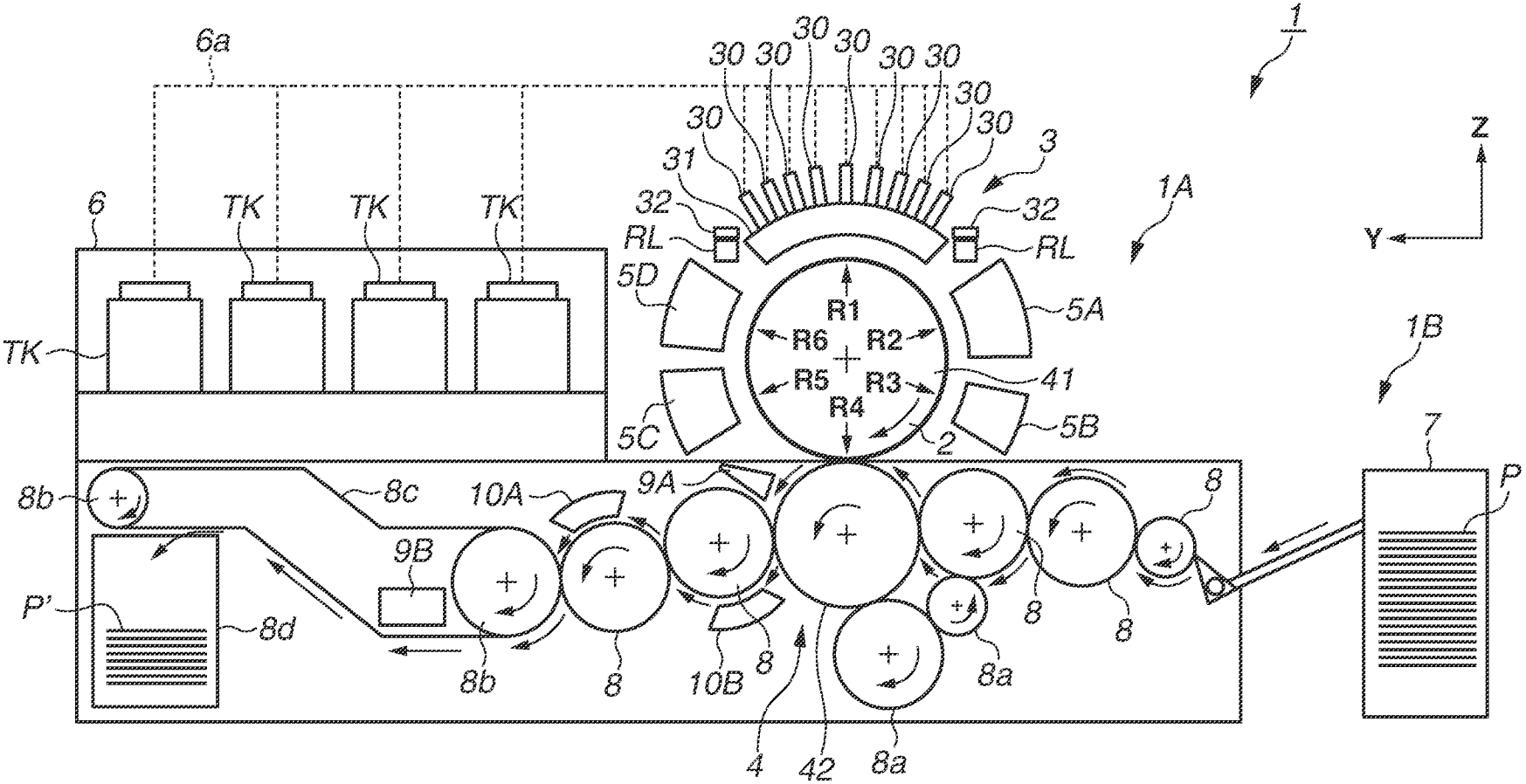
FIG. 1 schematically illustrates a recording system according to a first exemplary embodiment.

FIG. 1 is a front view schematically illustrating a recording system 1 according to an exemplary embodiment of the present disclosure. The recording system 1 is a sheet-fed inkjet printer (inkjet recording apparatus) that produces a recorded product P' by transferring an ink image onto a recording medium P via a transfer member 2. The recording system 1 includes a recording apparatus 1A and a conveyance apparatus 1B. In the present exemplary embodiment, the X direction, the Y direction, and the Z direction represent the depth direction, the width direction (the entire length direction), and the height direction of the recording system 1, respectively. The recording medium P is conveyed in the XY direction.

As will be used herein, "recording" is defined to include forming information having significant meanings, such as characters and graphics as well as forming images, marks, patterns, or the like on recording media in a broad sense regardless of whether the formed content has significant meaning or not, and processing media, without being limited by whether the formed content is visualized in such a manner that one can visually perceive. Further, sheet-shaped paper is assumed to be used as the "recording media" in the present exemplary embodiment, but the "recording media" may be cloths, plastic, film, or the like.

The ingredients of ink is not especially limited, but the present exemplary embodiment will be described assuming that aqueous pigment ink, which includes a color material, water, and resin, is used.

<Recording Apparatus>

The recording apparatus 1A includes a recording unit 3, a transfer unit 4, peripheral units 5A to 5D, and a supply unit 6 (described in connection with FIG. 8).

<Recording Unit>

Figure 2:
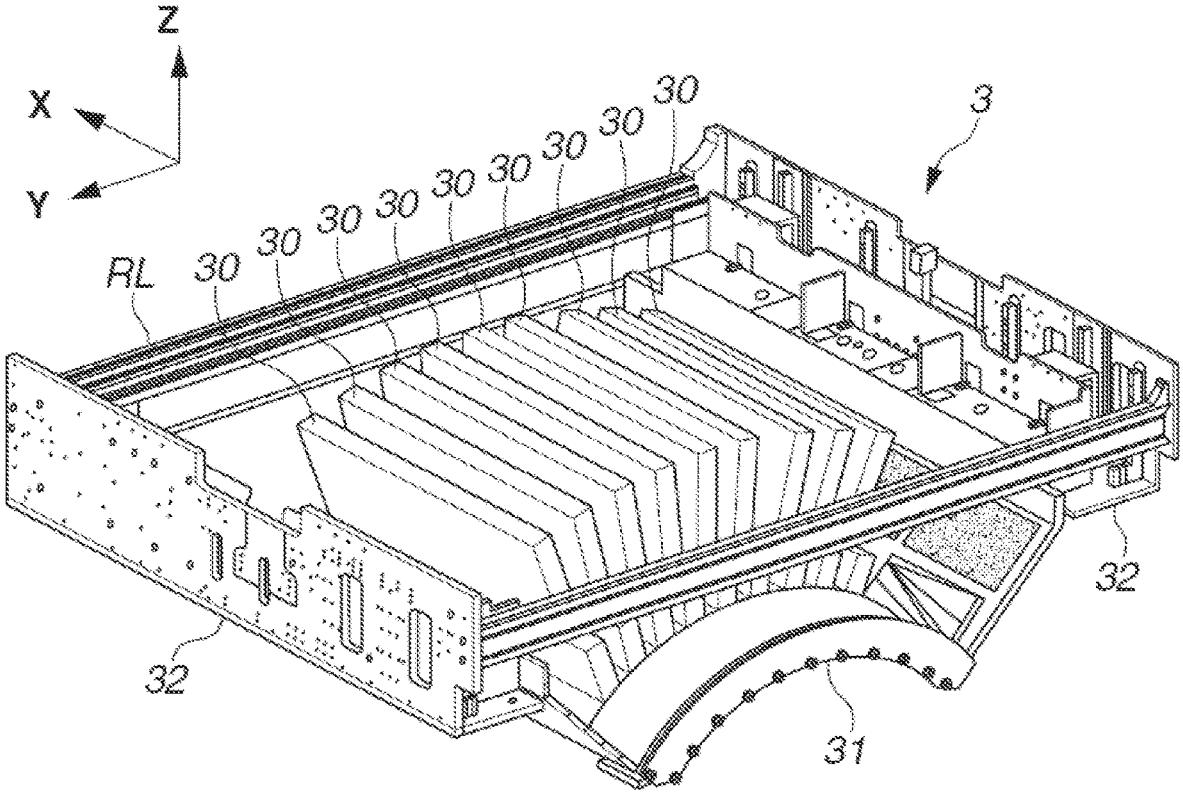
FIG. 2 is a perspective view of a recording unit according to the first exemplary embodiment.

The recording unit 3 includes a plurality of recording heads 30 and a carriage 31. The recording unit 3 will be described with reference to FIGS. 1 and 2. FIG. 2 is a perspective view of the recording unit 3. The recording heads 30 each discharge liquid ink onto the transfer member 2, thereby forming ink images as recording images onto the transfer member 2.

In the present exemplary embodiment, each of the recording heads 30, which are arranged in the Y direction, is a full-line recording head provided with nozzles arrayed in a range over a length corresponding to the width of an image recording region in recording media of a usable maximum size. The recording head 30 has an ink discharge surface with the nozzles open at the end portion thereof, the ink discharge surface of which faces the surface of the transfer member 2 by an extremely small space (for example, several millimeters). In the present exemplary embodiment, the transfer member 2 is configured to move circularly on a circular path, and the recording heads 30 are radially laid out accordingly.

A discharge element is included in each of the nozzles. The discharge element is an element to cause ink in the nozzle to be discharged by, for example, pressure generated in the nozzle, and a known technique for inkjet recording heads for inkjet printers is employable therefor. Examples of discharge elements include an element to discharge ink by causing film boiling in the ink using an electro-thermal converter to generate a bubble therein, an element to discharge ink using an electro-mechanical converter, and an element to discharge ink by using static electricity. The discharge element using an electro-thermal converter can be employed from the viewpoint of recording at high speed with high density.

In the present exemplary embodiment, nine recording heads 30 are arranged. The recording heads 30 discharge different kinds of ink from one another, respectively. The different kinds of ink are inks each containing a different color material, and are, for example, yellow ink, magenta ink, cyan ink, and black ink. Each of the recording heads 30 discharges one kind of ink, but may be configured to discharge a plurality of kinds of ink. Some of the plurality of recording heads 30 may discharge ink without a color material (for example, clear ink).

The carriage 31 supports the plurality of recording heads 30. The end portion of each of the recording heads 30 nearer the ink discharge surface is fixed to the carriage 31. This configuration allows the space between the ink discharge surface and the surface of the transfer member 2 to be held more precisely. The carriage 31 is movable along a pair of guide members RL with the recording heads 30 mounted thereon. In the present exemplary embodiment, the pair of guide members RL each are a rail member extending in the Y direction spaced apart from each other in the X direction. A slide portion 32 is provided at each of the side portions of the carriage 31 in the X direction. The slide portions 32 are engaged with the guide members RL, and slides in the Y direction along the guide members RL.

Figure 3:
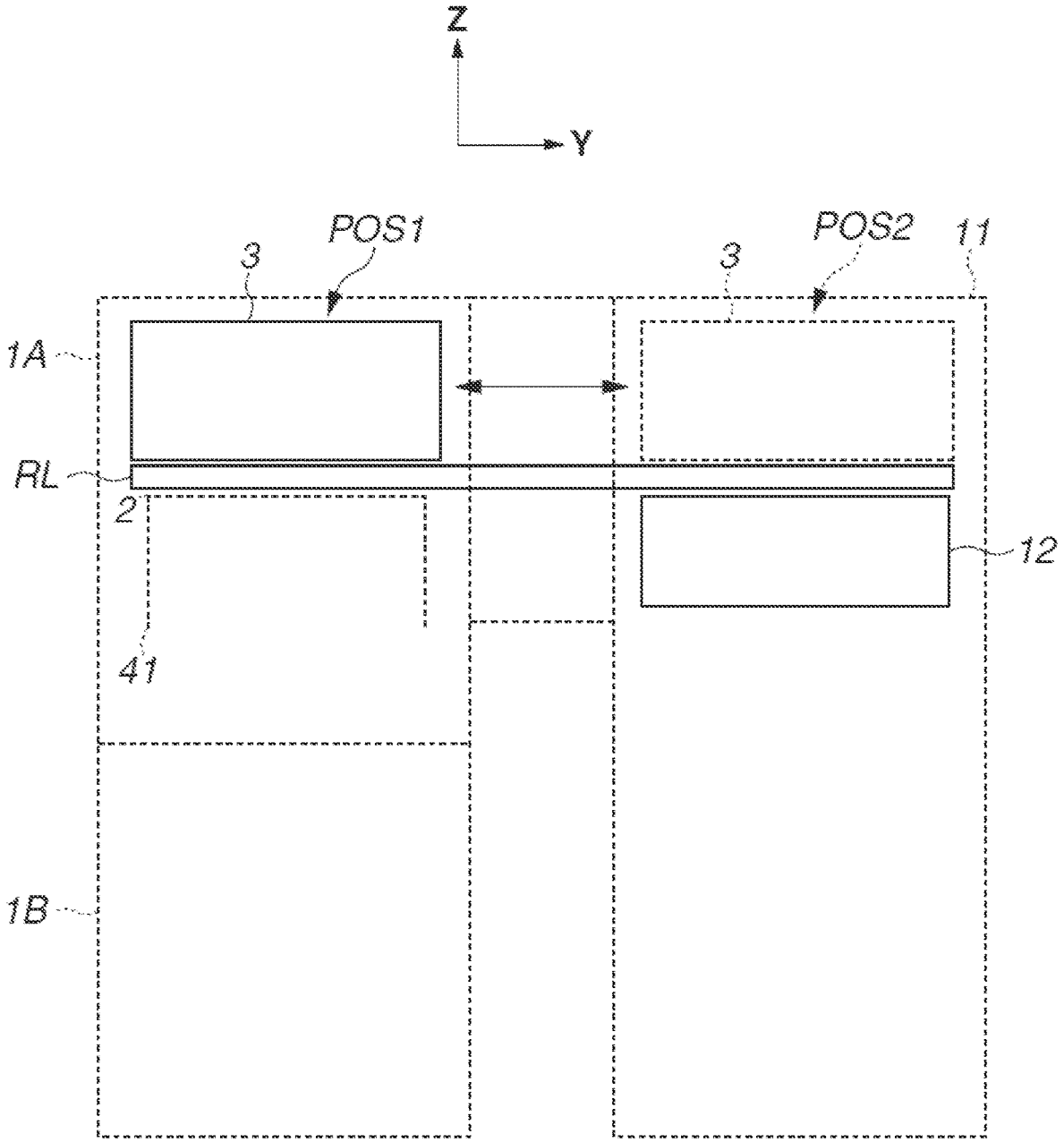
FIG. 3 illustrates movement of the recording unit according to the first exemplary embodiment.

FIG. 3 illustrates movement of the recording unit 3, and schematically illustrates the right side surface of the recording system 1. A back portion unit 11 is provided at the back portion of the recording system 1, and the back portion unit 11 includes a recovery unit 12. The recovery unit 12 includes a mechanism to recover the discharge performance of the recording heads 30. Examples of such a mechanism include a cap mechanism to cap the ink discharge surfaces of the recording heads 30, a wiper mechanism to wipe the ink discharge surfaces, and a suction mechanism to suck remaining ink in the recording heads 30 from the ink discharge surfaces with negative pressure.

The guide members RL are provided extending across the recovery unit 12 from the sides of the transfer member 2 supported by a transfer cylinder 41. The recording unit 3 is movable by a not-illustrated driving mechanism along the guide members RL between a discharge position POS1 of the recording unit 3 indicated by a solid line and a recovery position POS2 of the recording unit 3 indicated by a broken line. At the discharge position POS1, the recording unit 3 discharges ink onto the transfer member 2 with the ink discharge surfaces of the recording heads 30 facing the surface of the transfer member 2 (see state ST11 FIG. 7). The recording unit 3 is retracted from the discharge position POS1 to the recovery position POS2, where the recording heads 30 are located over the recovery unit 12 (see state ST12 FIG. 7). The recovery unit 12 at the recovery position POS2 can perform recovery processing on the recording heads 30 (see state ST13 FIG. 7).

<Transfer Unit>

The transfer unit 4 will be described with reference to FIG. 1. The transfer unit 4 includes the transfer cylinder 41 and a pressure cylinder 42. These cylinders each are a rotational member to rotate around the corresponding rotational axis in the X direction, and have a cylindrical outer peripheral surface. In FIG. 1, arrows illustrated in the individual graphics of the transfer cylinder 41 and the pressure cylinder 42 indicate rotational directions of them, and the transfer cylinder 41 rotates clockwise and the pressure cylinder 42 rotates counterclockwise.

The transfer cylinder 41 is a support member that supports the transfer member 2 on the outer peripheral surface thereof. The transfer member 2 is continuously or intermittently provided on the outer peripheral surface of the transfer cylinder 41 in the circumference direction. The transfer member 2 continuously provided there forms an endless belt-like shape. The transfer member 2 intermittently provided there is divided into a plurality of segments each shaped like a band having ends, each of the segments of which can be arranged on the outer peripheral surface of the transfer cylinder 41 at equal intervals in a circular arc manner.

The transfer member 2 is moved circularly on the circular path following the rotation of the transfer cylinder 41. The position of the transfer member 2 can be distinguished into a formation region R1, transfer pre-processing regions R2 and R3, a transfer region R4, a transfer post-processing region R5, and a discharge pre-processing region R6 according to the rotational phase of the transfer cylinder 41. The transfer member 2 passes by these regions circularly.

The formation region R1 is a region in which the recording unit 3 discharges ink onto the transfer member 2 to form an ink image. The transfer pre-processing regions R2 and R3 are processing regions in which the ink image is processed before transfer. The transfer pre-processing region R2 is a region in which the ink image is processed by the peripheral unit 5A, and the transfer pre-processing region R3 is a region in which the ink image is processed by the peripheral unit 5B. The transfer region R4 is a region in which the ink image on the transfer member 2 is transferred onto a recording medium P by the transfer unit 4. The transfer post-processing region R5 is a region in which post-processing is performed on the transfer member 2 after the transfer, and is a region in which the transfer member 2 is processed by the peripheral unit 5C. The discharge pre-process region R6 is a region in which pre-processing (an application of reaction liquid in the present exemplary embodiment) is performed on the transfer member 2 before ink is discharged, and is a region in which the transfer member 2 is processed by the peripheral unit 5D.

In the present exemplary embodiment, the formation region R1 is a region having a predetermined section, and the other regions R2 to R4 are substantially point-like (i.e., linear) regions. Using the analogy of a clock face, the formation region R1 is a range from approximately 11 o'clock to 1 o'clock, the transfer pre-processing region R2 is approximately the 2 o'clock position, and the transfer pre-processing region R3 is approximately the 4 o'clock position, in the present exemplary embodiment. The transfer region R4 is approximately the 6 o'clock position, the transfer post-processing region R5 is approximately the 8 o'clock region, and the discharge pre-processing region R6 is approximately the 10 o'clock position.

The transfer member 2 may form a single layer, but may be a laminate of a plurality of layers. The transfer member 2 formed of a plurality of layers may include, for example, three layers: a surface layer, an elastic layer, and a compression layer. The surface layer is the outermost layer having an image formation surface on which an ink image is formed. The compression layer provided thereon absorbs deformation, distributing a local pressure change, thereby allowing the transfer member 2 to keep the transferability even at high-speed recording. The elastic layer is a layer between the surface layer and the compression layer.

Various kinds of materials, such as resin and ceramic, can be used as the material for the surface layer as appropriate, but a material having a high compressive elastic modulus can be used in view of the durability and other properties. Specific examples thereof include acrylic resin, acrylic silicone resin, fluorine-containing resin, and a condensate acquired by condensing a hydrolytic organosilicon compound. The surface layer may be subjected to surface treatment to improve the wettability of the reaction liquid, the transferability, and other characteristics. Examples of the surface treatment include flame treatment, corona treatment, plasma treatment, polishing treatment, roughening treatment, active energy radiation irradiation treatment, ozone treatment, surfactant treatment, and silane coupling treatment. The surface layer may be subjected to combinations of a plurality of treatments among them. Further, an intended surface profile can also be provided on the surface layer.

Examples of the material for the compression layer include acrylonitrile-butadiene rubber, acrylic rubber, chloroprene rubber, urethane rubber, and silicone rubber. In molding such a rubber material, the rubber material may be prepared as a porous rubber material by blending a predetermined amount of a vulcanization agent, a vulcanization accelerator, or a similar material, and further blending a filler, such as a foaming agent, hollow fine particles, or salt, as appropriate. This arrangement allows bubble portions to be compressed with volume changes in reaction to various pressure changes, offering less deformation in the transfer member 2 in the directions but the compression direction, thereby providing more stable transferability and durability. The porous rubber material comes in two types of pore structures: a continuous pore structure, in which pores are continuous to one another, and an independent pore structure, in which pores are individually independent. Then, either structure may be used or both of these structures may be used together.

Various kinds of materials, such as resin and ceramic, can be used as the material for the elastic layer as appropriate. Various kinds of elastomer materials and rubber materials can be used in view of the processing characteristics and other characteristics. Specific examples thereof include fluorosilicone rubber, phenylsilicone rubber, fluororubber, chloropropylene rubber, urethane rubber, and nitrile rubber. Further examples include ethylene propylene rubber, natural rubber, styrene rubber, isoprene rubber, butadiene rubber, ethylene/propylene/butadiene copolymer, and nitrile butadiene rubber. Especially, silicone rubber, fluorosilicone rubber, and phenylsilicone rubber have a small compression set, having benefits to the dimensional stability and the durability. Further, these materials have an elasticity modulus less changeable due to temperature, having benefits to the transferability.

Various kinds of adhesive agents or two-sided adhesive tapes can also be used between the surface layer and the elastic layer and between the elastic layer and the compression layer for fixing them. Further, the transfer member 2 may include a reinforcement layer having a high compressive elastic modulus to reduce lateral extension in adding the transfer member 2 to the transfer cylinder 41 and to have a stable stiffness. Further, a woven fabric may be used as the reinforcement layer. The transfer member 2 can be fabricated of any combination of these layers made of the above-described materials.

The outer peripheral surface of the pressure cylinder 42 is put in pressure contact with the transfer member 2. At least one grip mechanism that holds the leading edge of a recording medium P is provided on the outer peripheral surface of the pressure cylinder 42. A plurality of grip mechanisms may be provided being spaced apart from one another in the circumferential direction of the pressure cylinder 42. As a recording medium P in close contact with the outer peripheral surface of the pressure cylinder 42 passes through a nip portion between the pressure cylinder 42 and the transfer member 2, the ink image on the transfer member 2 is transferred onto the recording medium P.

<Peripheral Units>

The peripheral units 5A to 5D are arranged around the transfer cylinder 41. In the present exemplary embodiment, the peripheral units 5A to 5D are, in this order, an absorption unit, a heating unit, a cleaning unit, and an application unit, respectively.

The absorption unit 5A is a mechanism to absorb a liquid component from the ink image on the transfer member 2 before the transfer, and, in particular, is a mechanism intended to absorb moisture from the ink image in the present exemplary embodiment. Reduction of moisture in the ink image prevents or reduces bleeding or the like in the image recorded on the recording medium P. The absorption unit 5A includes, for example, an absorption member to contact the ink image to reduce the amount of moisture in the ink image. The absorption member may be formed on the outer peripheral surface of a roller, or may be formed in an endless sheet-like shape and configured to run circularly. In light of protecting the ink image, the absorption member may move in synchronization with the transfer member 2, and the movement speed thereof may be equal to the circumferential speed of the transfer member 2. The absorption member may include a porous body in contact with the ink image. The mean pore diameter of the porous body may be 10 μm or smaller to prevent or reduce adhesion of a solid component in the ink thereto.

The heating unit 5B is a mechanism to heat the ink image on the transfer member 2 before the transfer. Heating the ink image causes the resin in the ink to be melted and a film of the ink image to be formed, thereby improving the transferability onto the recording medium P. The heating temperature can be set to a minimum film formation temperature (MFT) of the resin or higher. The MFT can be measured by a commonly known method, such as using any of respective apparatuses in compliance with Japanese Industrial Standards (JIS) K 6828-2:2003 and International Organization Standards (ISO) 2115: 1996. From the viewpoint of the transferability and the fastness of the image, the ink image may be heated at a temperature higher than the MFT by 10° C. or more, and, further, may be heated at a temperature higher than the MFT by 20° C. or more. A known heating device, for example, various types of lamps such as an infrared lamp and a warm air fan, can be used as the heating unit 5B. An infrared heater can be used in light of the heating efficiency.

The cleaning unit 5C is a mechanism to clean the surface of the transfer member 2 after the transfer. The cleaning unit 5C removes ink remaining on the transfer member 2, dust (for example, paper powder) on the transfer member 2, and the like. For example, a known method, such as a method of placing a porous member in contact with the transfer member 2, a method of rubbing the surface of the transfer member 2 with a brush, and a method of raking the surface of the transfer member 2 with a blade, can be used for the cleaning unit 5C as appropriate. Further, a known shape, such as a roller-like shape and a web-like shape, can be employed for a cleaning member used in the cleaning.

The application unit 5D is a mechanism to apply the reaction liquid onto the transfer member 2 before the ink is discharged by the recording unit 3 after the transfer member 2 is cleaned by the cleaning unit 5C. The reaction liquid is liquid that promotes coagulation of the color material, and contains, for example, a component that increases the viscosity of the ink. The component that increases the viscosity of the ink may be metal ion, a polymer coagulant, or the like and is not particularly limited, and the reaction liquid can contain a substance that causes a pH change of the ink to coagulate the color material in the ink and can contain an organic acid as this component.

Examples of the mechanism to apply the reaction liquid include a roller, a recording head, a die coating device (a die coater), and a blade coating device (a blade coater). Applying the reaction liquid to the transfer member 2 before the ink is discharged onto the transfer member 2 reduces bleeding, in which adjacent ink droplets are mixed together, and beading, in which an ink droplet landed first is attracted to an ink droplet landed after that.

As described above, the recording apparatus 1A includes the absorption unit 5A, the heating unit 5B, the cleaning unit 5C, and the application unit 5D as the respective peripheral units in the present exemplary embodiment, but a function of cooling the transfer member 2 may be provided to a part of these units or a cooling unit may be added. In the present exemplary embodiment, the temperature of the transfer member 2 may be raised due to the heat of the heating unit 5B. If the temperature of the ink image exceeds the boiling point of water, which is the main solvent of the ink, after the ink is discharged onto the transfer member 2 by the recording unit 3, this may lead to a reduction in the performance of absorbing moisture by the absorption unit 5A. The performance of absorbing moisture can be maintained by cooling the transfer member 2 to keep the temperature of the discharged ink below the boiling point of water.

The cooling unit may be an air blowing mechanism to blow air to the transfer member 2 or a mechanism to place a member (for example, a roller) in contact with the transfer member 2 and cools this member by air cooling or water cooling. Alternatively, the cooling unit may be a mechanism to cool the cleaning member of the cleaning unit 5C. The cooling period may be a period until the reaction liquid is applied after the transfer.

<Supply Unit>

The supply unit 6 is a mechanism to supply each ink to the corresponding one of the recording heads 30 of the recording unit 3. The supply unit 6 may be provided at the back portion unit 11 (FIG. 3). The supply unit 6 includes a storage unit TK for each kind of ink to store therein the ink. The storage unit TK may include an ink tank 110 and a buffer tank 100 (refer to FIG. 8). Each of the storage units TK and the corresponding one of the recording heads 30 (e.g., one of the nine recording heads 30) are in communication with each other via a flow path 6*a*, and the ink is supplied from the storage unit TK to the recording head 30.

The flow path 6*a* may be a flow path to circulate the ink between the storage unit TK and the recording head 30, and the supply unit 6 may include a pump or another device to circulate the ink. A degassing mechanism to degas the ink to remove bubbles therein may be provided on the flow path 6*a* or in the storage unit TK. A valve to make an adjustment between the liquid pressure of the ink and the atmospheric pressure may be provided on the flow path 6*a* or in the storage unit TK. The heights of the storage unit TK and the recording head 30 in the Z direction may be designed to position the ink liquid surface in the storage unit TK lower than the ink discharge surface of the recording head 30.

<Conveyance Apparatus>

The conveyance apparatus 1B is an apparatus to feed a recording medium P to the transfer unit 4, and discharges the recorded product V with the ink image transferred thereon from the transfer unit 4. The conveyance apparatus 1B includes a feeding unit 7, a plurality of conveyance cylinders 8 and 8*a*, two sprockets 8*b*, a chain 8*c*, and a collection unit 8*d*. In FIG. 1, the arrow inside the graphic of each element in the conveyance apparatus 1B indicates the rotational direction of this element, and the arrows outside them indicate the conveyance route of the recording medium P or the recorded product P'. The recording medium P is conveyed from the feeding unit 7 to the transfer unit 4, and the recorded product P' is conveyed from the transfer unit 4 to the collection unit 8*d*. The feeding unit 7 side and the collection unit 8*d* side may be referred to as an upstream side and a downstream side in the conveyance direction, respectively.

The feeding unit 7 includes a loading unit in which a plurality of recording media P is loaded, and also includes a feeding mechanism to feed the recording media P one by one from the loading unit to the conveyance cylinder 8 positioned on the most upstream side. The conveyance cylinders 8 and 8*a* each is a rotational member to rotate around the rotational axis in the X direction, and have a cylindrical outer peripheral surface. At least one grip mechanism to hold the leading edge of the recording medium P (or the recorded product P') is provided on the outer peripheral surface of each of the conveyance cylinders 8 and 8*a*. Gripping operation and releasing operation of each grip mechanism are controlled in such a manner that the recording medium P is transferred between adjacent conveyance cylinders.

The two conveyance cylinders 8*a* are conveyance cylinders for flipping the recording medium P, and are not used in the conveyance of the recording medium P in simplex recording. In duplex recording on the recording medium P, the recording medium P is delivered to the conveyance cylinder 8*a* without being delivered from the pressure cylinder 42 to the conveyance cylinder 8 adjacent thereto on the downstream side after the transfer onto the surface. The front side and the back side of the recording medium P are flipped via the two conveyance cylinders 8*a*, and the recording medium P is delivered to the pressure cylinder 42 again via the conveyance cylinder 8 on the upstream side of the pressure cylinder 42. This causes the back side of the recording medium P to face the transfer cylinder 41, and another ink image is transferred onto the back side.

The chain 8*c* is wound around between the two sprockets 8*b*. One of the two sprockets 8*b* is a driving sprocket, and the other of them is a driven sprocket. The chain 8*c* runs circularly by rotation of the driving sprocket. A plurality of grip mechanisms is provided on the chain 8*c*, spaced apart from each other in the longitudinal direction thereof. The grip mechanisms hold the edge portion of the recorded product P'. The recorded product P' is delivered to the grip mechanism of the chain 8*c* from the conveyance cylinder 8 located on the downstream end, and the recorded product P' held by the grip mechanism is conveyed to the collection unit 8*d* by the running of the chain 8*c* and is released from the grip. As a result, the recorded product P' is loaded into the collection unit 8*d*.

<Post-Processing Unit>

The conveyance apparatus 1B includes post-processing units 10A and 10B. The post-processing units 10A and 10B are mechanisms disposed downstream of the transfer unit 4 and functioning to perform post-processing on the recorded product P'. The post-processing unit 10A performs processing on the front side of the recorded product P' and the post-processing unit 10B performs processing on the back side of the recorded product P'. Examples of the processing include applying a coating on the image recorded surface of the recorded product P' for the purpose of, for example, protecting or glazing the image. Examples of the coating include application of liquid, welding of a sheet, and lamination.

<Inspection Unit>

The conveyance apparatus 1B includes inspection units 9A and 9B. The inspection units 9A and 9B are mechanisms disposed downstream of the transfer unit 4, and functioning to inspect the recorded product P'.

In the present exemplary embodiment, the inspection unit 9A is an imaging device to image the image recorded on the recorded product V and includes an image sensor, such as a charge-coupled device (CCD) sensor and a complementary metal-oxide semiconductor (CMOS) sensor. The inspection unit 9A images the recorded image during a recording operation being continuously performed. The recording system 1 can check change in the color and other qualities of the recorded image over time based on the image imaged by the inspection unit 9A to determine whether the recorded data will be corrected. In the present exemplary embodiment, the imaging range of the inspection unit 9A is set in the outer peripheral surface of the pressure cylinder 42, and the inspection unit 9A is disposed to partially image the recorded image immediately after the transfer. The recording system 1 may inspect the whole recorded image or may inspect the recorded image per predetermined number of pages by the inspection unit 9A.

In the present exemplary embodiment, the inspection unit 9B is also an imaging device to image the image recorded on the recorded product V and includes an image sensor, such as a CCD sensor and a CMOS sensor. The inspection unit 9B images the recorded image during a test recording operation. The inspection unit 9B images the whole recorded image, and the recording system 1 can configure basic settings of various kinds of corrections regarding the recorded data based on the image captured by the inspection unit 9B. In the present exemplary embodiment, the inspection unit 9B is disposed at a position at which it images the recorded product V conveyed by the chain 8*c*. For the recorded image to be imaged by the inspection unit 9B, the running of the chain 8*c* is temporarily stopped and the whole recorded image is imaged. The inspection unit 9B may be a scanner to scan on the recorded product V.

<Control Unit>

Figure 4:
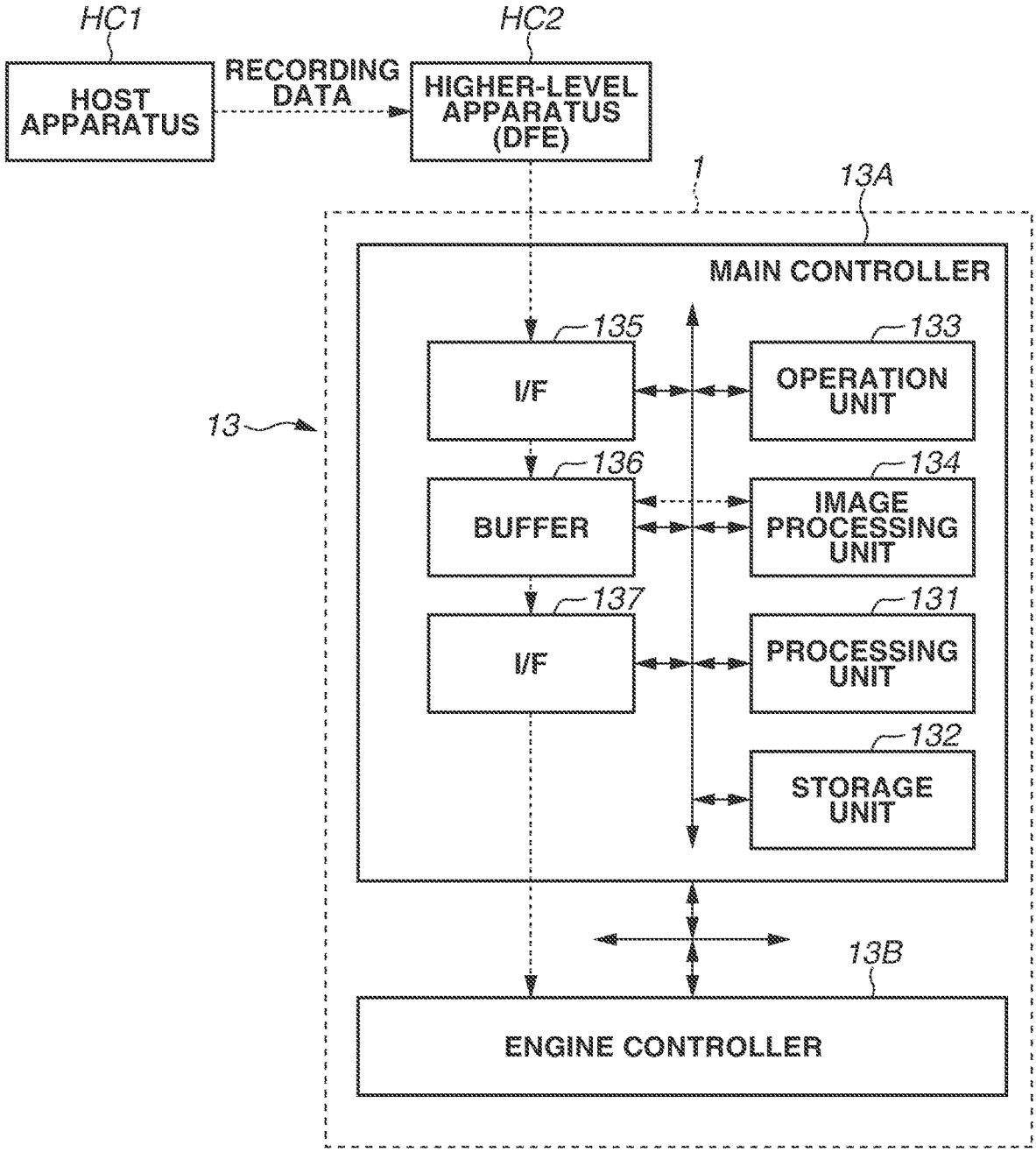
FIG. 4 is a block diagram of a control system of the recording system according to the first exemplary embodiment.
Figure 5:
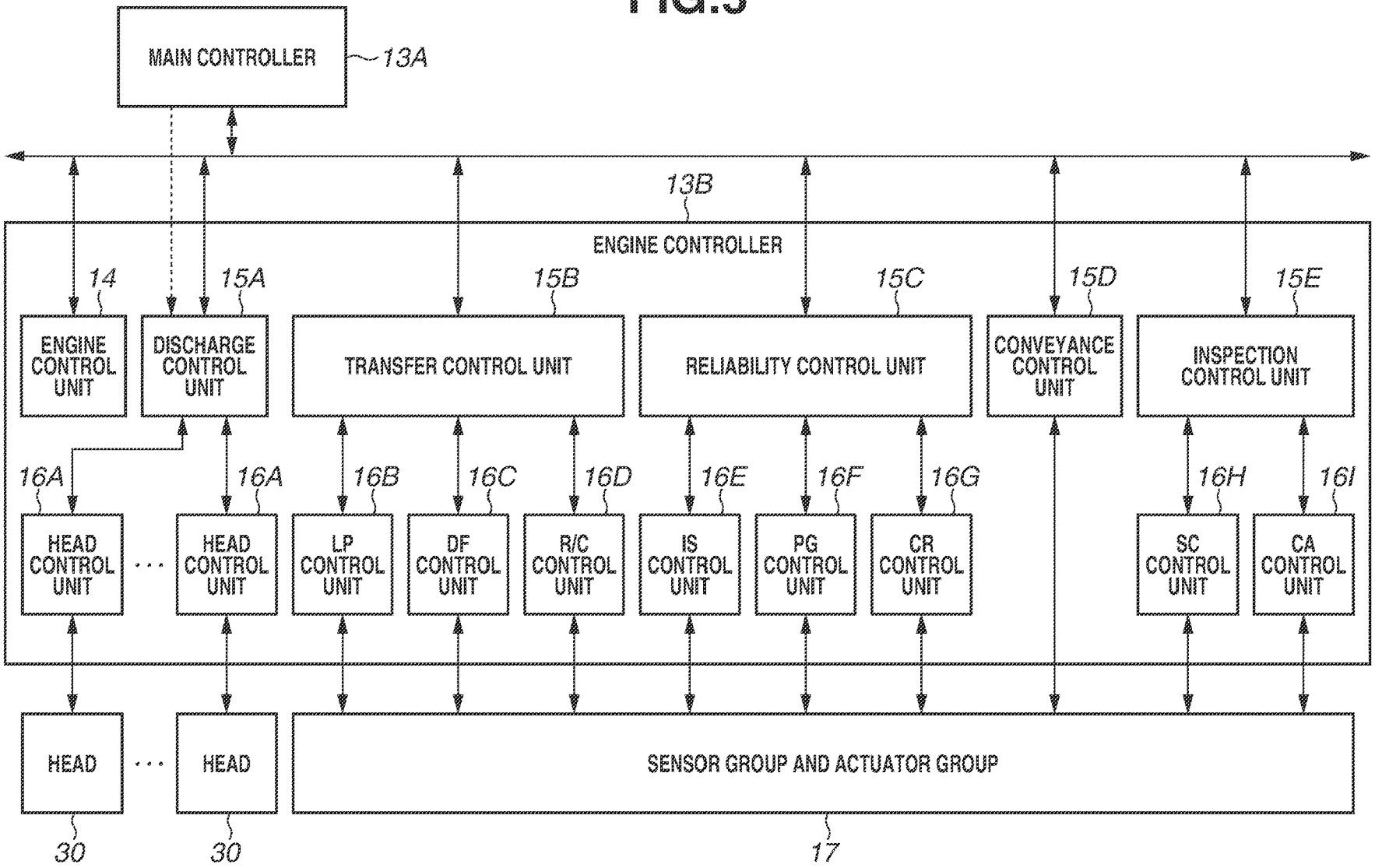
FIG. 5 is a block diagram illustrating the control system of the recording system according to the first exemplary embodiment.

Next, a control unit of the recording system 1 will be described. FIGS. 4 and 5 are block diagrams of a control unit 13 of the recording system 1. The control unit 13 is communicably connected to a higher-level apparatus (digital front end (DFE)) HC2, and the higher-level apparatus HC2 is communicably connected to a host apparatus HC1.

Recording data, which serves as the source of the recorded image, is generated in the host apparatus HC1. The recording data at this time is generated in the form of an electronic file, such as a document file and an image file. This recording data is transmitted to the higher-level apparatus HC2, and the higher-level apparatus HC2 converts the received recording data into a data format usable by the control unit 13 (for example, Cyan, Magenta, Yellow, and Black (CMYK)-color data). The recording data after the conversion is transmitted from the higher-level apparatus HC2 to the control unit 13, and the control unit 13 starts the recording operation based on the received recording data.

In the present exemplary embodiment, the control unit 13 is roughly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor, such as a central processing unit (CPU), and runs programs stored in the storage unit 132 to generally control the main controller 13A. The storage unit 132 is a storage device, such as a random access memory (RAM), a read only memory (ROM), a hard disk, or a solid-state drive (SSD). Then, the storage unit 132 stores programs that the CPU 131 runs and data therein, and also provides a work area to the CPU 131. The operation unit 133 is an input device, such as a touch panel, a keyboard, and a mouse, and receives instructions by a user.

The image processing unit 134 is, for example, an electronic circuit including an image processing processor. The buffer 136 is, for example, a RAM, a hard disk, or an SSD. The communication I/F 135 communicates with the higher-level apparatus HC2, and the communication I/F 137 communicates with the engine controller 13B. In FIG. 4, dashed arrows each indicate an example of the course of processing on the recording data. The recording data received from the higher-level apparatus HC2 via the communication I/F 135 is accumulated in the buffer 136. The image processing unit 134 reads out the recording data from the buffer 136, performs predetermined image processing on the read recording data, and stores the recording data into the buffer 136 again. The recording data after the image processing that is stored in the buffer 136 is transmitted from the communication I/F 137 to the engine controller 13B.

As illustrated in FIG. 5, the engine controller 13B includes control units 15A to 15E and 16A to 16I, and acquires results of detection by a sensor group and actuator group 17 included in the recording system 1 and controls driving thereof. Each of these control units includes a processor such as a CPU, storage devices such as a RAM and a ROM, and an interface with an external device. The division of the control unit is an example, and some control may be performed by a plurality of further subdivided control units, or the engine controller 13B may be configured in such a manner that a plurality of control units is integrated into one control unit that performs the entire control of them to the contrary.

An engine control unit 14 generally controls the engine controller 13B. The discharge control unit 15A controls a recording head control unit 16A provided for each of the recording heads 30. The discharge control unit 15A also converts the recording data received from the main controller 13A into a data format suitable to drive the recording head 30, such as raster data. Each of the recording head control units 16A controls the discharge of the recording head 30 corresponding thereto.

The transfer control unit 15B controls an LP control unit 16B, a DF control unit 16C, and an R/C control unit 16D. The LP control unit 16B controls the absorption unit 5A. The DF control unit 16C controls the heating unit 5B. The R/C control unit 16D controls the cleaning unit 5C and the application unit 5D.

The reliability control unit 15C controls an IS control unit 16E, a PG control unit 16F, and a CR control unit 16G. The IS control unit 16E controls the supply unit 6. The PG control unit 16F controls the recovery unit 12. The CR control unit 16G controls the driving mechanism to move the recording unit 3 between the discharge position POS1 and the recovery position POS2.

The conveyance control unit 15D controls the conveyance apparatus 1B. The inspection control unit 15E controls an SC control unit 16H and a CA control unit 16I. The SC control unit 16H controls the inspection unit 9B. The CA control unit 16I controls the inspection unit 9A.

The sensor group in the sensor group and actuator group 17 includes a sensor to detect the position and the speed of a movable portion, a sensor to detect the temperature, an image sensor, and the like. The actuator group includes a motor, an electromagnetic solenoid, an electromagnetic valve, and the like.

<Operation Example>

Figure 6:
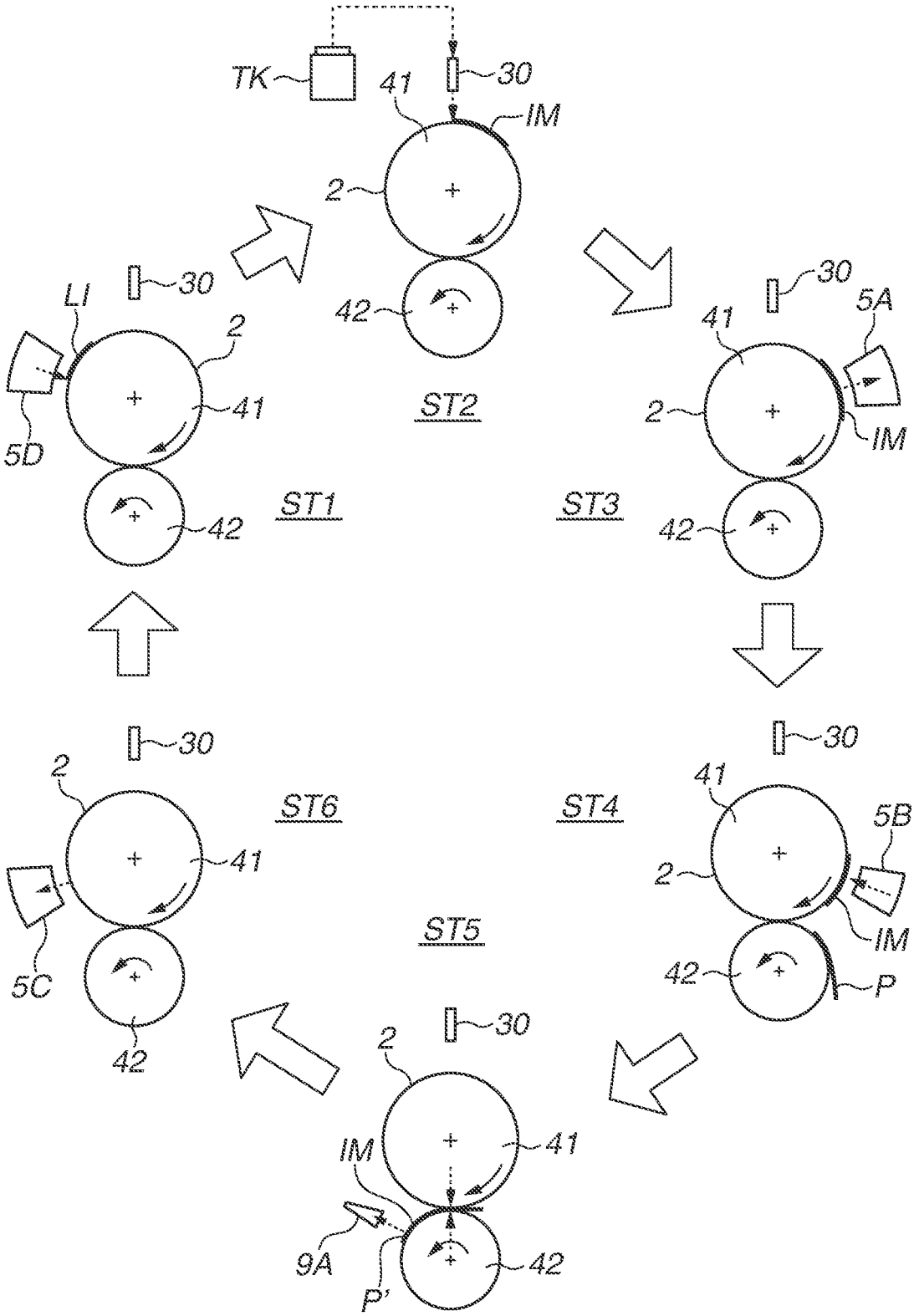
FIG. 6 illustrates an operation example of the recording system according to the first exemplary embodiment.

FIG. 6 schematically illustrates an example of the recording operation. As the transfer cylinder 41 and the pressure cylinder 42 are rotated, each of the following processes is performed circularly. As indicated by a state ST1, the reaction liquid LI is applied from the application unit 5D onto the transfer member 2 first. The reaction liquid LI portion on the transfer member 2 is moving with the rotation of the transfer cylinder 41. When the reaction liquid LI portion reaches the position under the recording head 30, the ink is discharged from the recording head 30 onto the transfer member 2 as indicated by a state ST2. As a result, an ink image IM is formed. At this time, the discharged ink is mixed with the reaction liquid LI on the transfer member 2, and this promotes the coagulation of the color material. The discharged ink is supplied from the storage unit TK of the supply unit 6 to the recording head 30.

The ink image IM on the transfer member 2 is moving with the rotation of the transfer member 2. When the ink image IM reaches the absorption unit 5A, the moisture is absorbed from the ink image IM by the absorption unit 5A as indicated by a state ST3. When the ink image IM reaches the heating unit 5B, the ink image IM is heated by the heating unit 5B as indicated by a state ST4, causing the resin in the ink image IM to be melted, forming the film of the ink image IM. A recording medium P is conveyed by the conveyance apparatus 1B in synchronization with such formation of the ink image IM.

As indicated by a state ST5, the ink image IM and the recording medium P reach the nip portion between the transfer member 2 and the pressure cylinder 42, and the ink image IM is transferred onto the recording medium P and the recorded product P' is produced. After passing through the nip portion, the image recorded on the recorded product P' is imaged by the inspection unit 9A and the recorded image is inspected. The recorded product P' is conveyed by the conveyance apparatus 1B to the collection unit 8*d*.

The portion on the transfer member 2 where the ink image IM had been formed is cleaned by the cleaning unit 5C as indicated by a state ST6 when reaching the cleaning unit 5C. The end of the cleaning means that the transfer member 2 completes one full rotation, and the transfer of the ink image onto another recording medium P is repeated in a similar procedure. The recording system 1 has been described assuming that the ink image IM is transferred onto one recording medium P once by one rotation of the transfer member 2 in the above description for facilitating a better understanding, but the ink image IM can be continuously transferred onto a plurality of recording media P by one rotation of the transfer member 2.

Figure 7:
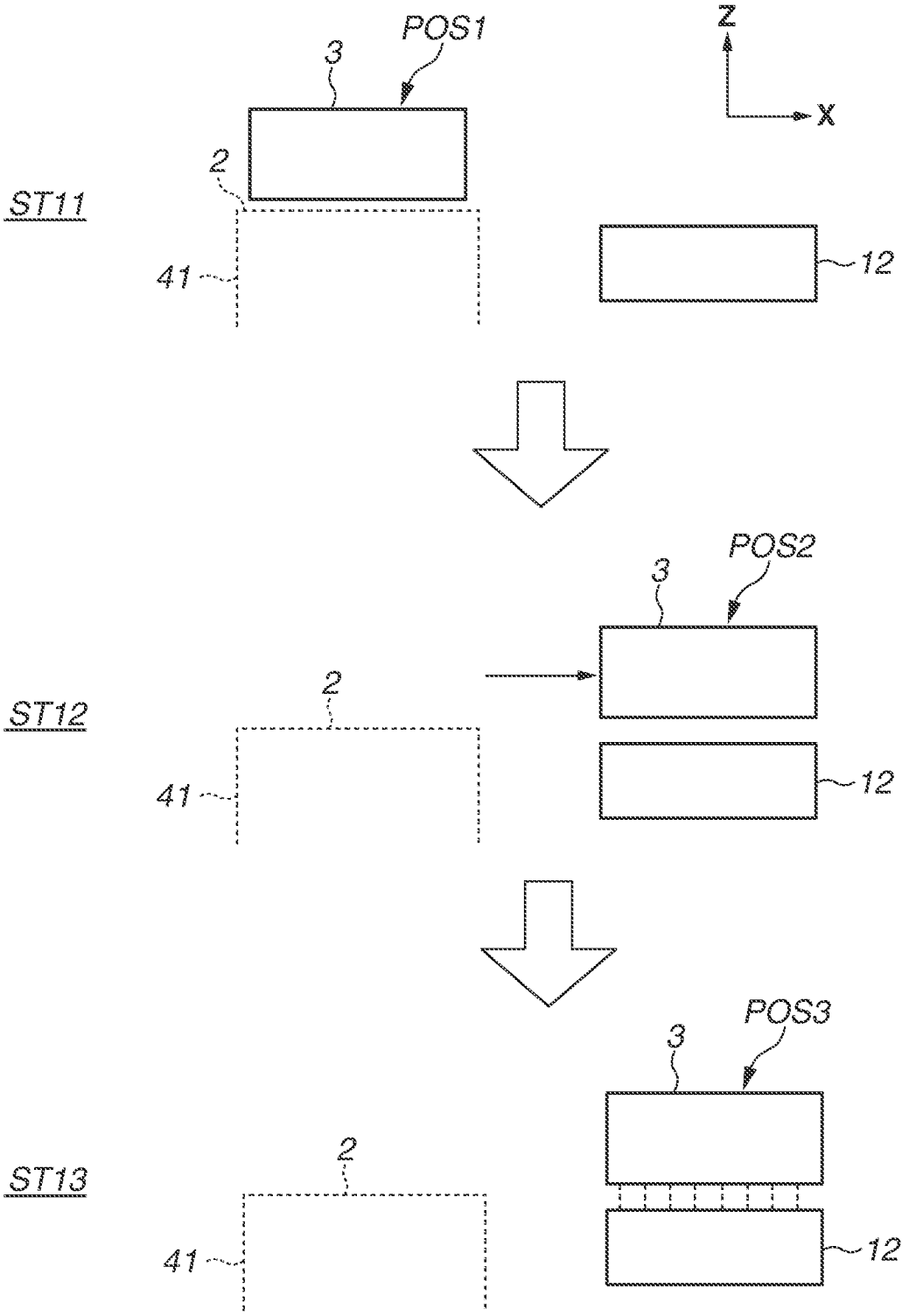
FIG. 7 illustrates an operation example of the recording system according to the first exemplary embodiment.

Continuing such a recording operation involves maintenance of each of the recording heads 30. FIG. 7 illustrates an operation example in the maintenance of each of the recording heads 30. A state ST11 indicates a state that the recording unit 3 is located at the discharge position POS1. A state ST12 indicates a state that the recording unit 3 is moved to the recovery position POS2. After that, the processing for recovering the performance of each of the recording heads 30 in the recording unit 3 is performed by the recovery unit 12 as indicated by a state ST13.

First Exemplary Embodiment

Figure 8:
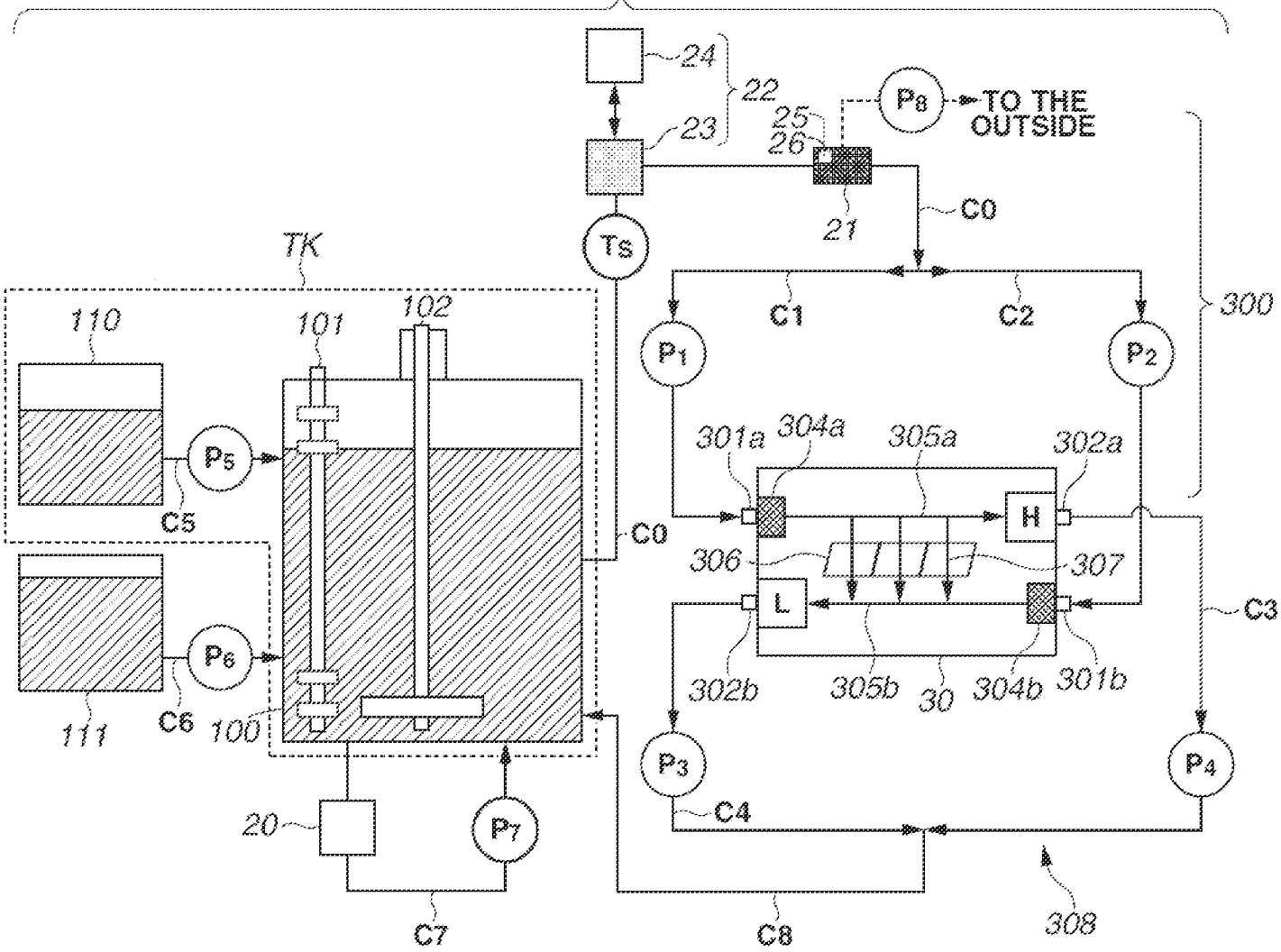
FIG. 8 is a schematic view illustrating a detailed configuration of a supply unit of a recording apparatus according to the first exemplary embodiment.

FIG. 8 is a schematic view illustrating a detailed configuration of the supply unit 6 employed in the recording apparatus 1A. In the supply unit 6, the ink circulates between the buffer tank 100 and the recording head 30. The recording head 30 discharges the ink based on the image data, and undischarged ink is collected into the buffer tank 100.

As noted above, the storage unit TK may include the ink tank 110 and the buffer tank 100. The ink tank 110 is a tank to store the ink to be supplied into the buffer tank 100, and is configured detachably mountable on the main body of the recording apparatus 1A. The supply of the ink from the ink tank 110 to the buffer tank 100 may be conducted based on an instruction from the IS control unit 16E or may be conducted when the ink tank 110 is replaced. Further, the ink tank 110 may include a stirring unit for stirring the ink (not illustrated), and a detection unit for detecting the amount of stored ink (not illustrated) therein. A replenishment pump P5 for replenishing the ink from the ink tank 110 to the buffer tank 100 is connected to a tank connection flow path C5 connecting the buffer tank 100 and the ink tank 110.

A liquid level detection unit 101, such as a float switch and a capacitance sensor, is provided inside the buffer tank 100. When a reduction more than a predetermined amount in the amount of the ink in the buffer tank 100 is detected by the liquid level detection unit 101 or the concentration of the ink in the buffer tank 100 changes by more than a predetermined concentration, the ink is replenished from the ink tank 110 to the buffer tank 100.

The buffer tank 100 is a storage unit in which the ink supplied from the ink tank 110 is stored. An upstream supply flow path C0 for supplying the ink from the buffer tank 100 to the recording head 30 is connected to the buffer tank 100. The upstream supply flow path C0 branches into a first supply flow path C1 for supplying the ink to a first inflow port 301*a* of the recording head 30 and a second supply flow path C2 for supplying the ink to a second inflow port 301*b* of the recording head 30.

Further, a downstream collection flow path C8 for collecting the ink from the recording head 30 is connected to the buffer tank 100. The downstream collection flow path C8 is a flow path that connects a point at which a first collection flow path C3 for collecting the ink from a first collection port 302*a* of the recording head 30 and a second collection flow path C4 for collecting the ink from a second collection port 302*b* join together, and the buffer tank 100 to each other.

In other words, a circulation flow path through which the ink circulates is formed of the buffer tank 100, the upstream supply flow path C0, the first supply flow path C1, the second supply flow path C2, the recording head 30, the first collection flow path C3, the second collection flow path C4, and the downstream collection flow path C8. The upstream supply flow path C0, the first supply flow path C1, and the second supply flow path C2 will be collectively referred to as a supply flow path 300, and the first collection flow path C3, the second collection flow path C4, and the downstream collection flow path C8 will be collectively referred to as a collection flow path 308.

A temperature detection unit TS to detect the temperature of the ink flowing into the recording head 30 is provided on the upstream supply flow path C0 in the supply flow path 300. The temperature detection unit TS may be provided in the recording head 30.

A stirring unit 102 for stirring the ink in the tank is provided in the buffer tank 100, and the concentration of the ink is kept uniform by the stirring unit 102. Further, the buffer tank 100 includes an atmosphere communication port (not illustrated) to establish communication between the inside and the outside of the tank, and can discharge bubbles in the ink to the outside.

Further, a concentration measurement unit 20 to measure the concentration of the ink in the tank is connected to the buffer tank 100 via a flow path C7. A transparent flow path to allow ink subject to concentration measurement to pass through is formed in the concentration measurement unit 20. The transparent flow path is made of, for example, silica glass or sapphire glass. The ink is circulated between the concentration measurement unit 20 and the buffer tank 100 by a pump P7 disposed on the flow path C7.

Further, a dilution water tank 111 to store dilution water for diluting the ink in the tank in response to an increase in the concentration of the ink in the buffer tank 100 is connected to the buffer tank 100. In the present exemplary embodiment, pure water is used as the dilution water. If the concentration of the ink in the buffer tank 100 measured by the concentration measurement unit 20 is higher than a predetermined value, dilution water is supplied from the dilution water tank 111 by a pump P6 via a flow path C6. This allows the concentration of the ink in the buffer tank 100 to be kept at a concentration level appropriate for the recording operation performed by the recording head 30. The dilution water tank 111 may include a detection unit for detecting the amount of dilution water stored therein.

A first supply pump P1 is disposed on the first supply flow path C1 and a second supply pump P2 is disposed on the second supply flow path C2 in the supply flow path 300. The first supply pump P1 and the second supply pump P2 function as circulation units for circulating the ink in the circulation flow path while supplying the ink to the recording head 30.

A pressure control mechanism is provided inside the recording head 30. The pressure control mechanism performs control in such a manner that the pressure on the ink flowing in the flow path fluctuates within a desired pressure range. In the present exemplary embodiment, the recording head 30 includes a high-pressure control unit H and a low-pressure control unit L to function with a control pressure lower than the high-pressure control unit H, as the pressure control mechanism.

The ink flowing into the recording head 30 via the first inflow port 301*a* flows through a filter 304*a* and a common supply flow path 305*a*, and, after that, passes through the high-pressure control unit H and flows out into the first collection flow path C3 via the first collection port 302*a*. The ink flowing into the recording head 30 via the second inflow port 301*b* flows through a filter 304*b* and a common collection flow path 305*b*, and, after that, passes through the low-pressure control unit L and flows out into the second collection flow path C4 via the second collection port 302*b*.

The pressure on the ink is controlled in such a manner that a differential pressure is generated between the common supply flow path 305*a* and the common collection flow path 305*b* with the aid of the two pressure control mechanisms (the high-pressure control unit H and the low-pressure control unit L) and the two supply pumps (the first supply pump P1 and the second supply pump P2). This produces an ink flow from the common supply flow path 305*a* via discharge unit flow paths 307 connected to a plurality of discharge units 306 to the common collection flow path 305*b* and, along therewith, the ink supplied from each of the inflow ports 301*a* and 301*b* partially flows into each of the collection ports 302*a* and 302*b* without passing through the discharge unit 306. The discharge unit flow path 307 is a flow path through which the liquid passes near the opening portion of the discharge unit 306. The common supply flow path 305*a*, the discharge unit flow path 307, and the common collection flow path 305*b* are included in the above-described circulation flow path.

In such a configuration, if gas dissolved in the ink is blended into bubbles remaining in the discharge unit flow path 307 and, if further these bubbles grow inside the recording head 30, the bubbles clog in the discharge unit 306 or the flow path, hindering the discharge performance and causing an image defect. For that reason, a degassing unit 21 for degassing the ink and a temperature adjustment unit 22 for adjusting the temperature of the ink between the degassing unit 21 and the buffer tank 100 are provided on the supply flow path 300 (the upstream supply flow path C0) according to the present exemplary embodiment.

The degassing unit 21 includes a degassing module 25, and a depressurization pump P8 is connected to the degassing module 25 as a negative-pressure generation unit to produce a negative pressure in the degassing module 25. The degassing module 25 includes a porous hollow fiber membrane 26 therein, and allows the inside of the hollow fiber membrane 26 to be depressurized by the driving of the depressurization pump P8. When the ink flows into the degassing module 25 module with the hollow fiber membrane 26 depressurized by the depressurization pump P8, the dissolved gas (dissolved oxygen) is sucked into the hollow fiber membrane 26 and is collected from the depressurization pump P8 to the outside.

The degassing module 25 is depressurized to approximately −90 to −60 kilopascal (kPa) by the depressurization pump P8, degassing the ink up to a dissolved oxygen of approximately 1 to 5 parts per million (ppm) after passing through the degassing module 25. As a result, the amount of dissolved oxygen in the ink flowing in the upstream supply flow path C0, the first supply flow path C1, and the second supply flow path C2 in the supply flow path 300 on the downstream side of the degassing unit 21 is kept within a predetermined range by the degassing unit 21.

The temperature adjustment unit 22 includes a heat exchanger 23 and a temperature adjustment device 24. A constant-temperature medium is stored inside the heat exchanger 23. Further, a metallic pipe (not illustrated) is disposed in the constant-temperature medium in the heat exchanger 23, and both ends of the metallic pipe are connected to the upstream supply flow path C0, the metallic pipe of which serves as a part of the upstream supply flow path C0. The ink circulating in the supply flow path 300 undergoes a temperature reduction by heat exchange with the constant-temperature medium in the process of passing through the metallic pipe. The heat exchanger 23 may be configured like a water tank capable of storing the constant-temperature medium therein. Alternatively, the heat exchanger 23 may be a multi-tubular heat exchanger, a plate-type heat exchanger, or a finned tube-type heat exchanger, or may be a combination of a plurality of types among them.

The temperature adjustment device 24 for adjusting the temperature of the constant-temperature medium is connected to the heat exchanger 23, and the constant-temperature medium under the temperature adjustment circulates between the temperature adjustment device 24 and the heat exchanger 23. The temperature adjustment device 24 has a configuration with devices configured to contribute to the temperature adjustment of the constant-temperature medium, including a not-illustrated cooler, a heating heater, a constant-temperature medium circulation pump, and a temperature sensor. Further, a not-illustrated breaker is connected to the temperature adjustment device 24, and prevents the troubles with the temperature adjustment apparatus 24 from affecting the other devices.

In the present exemplary embodiment, the temperature adjustment unit 22 is disposed upstream of the degassing unit 21 in the ink supply direction. This layout allows the ink supplied from the buffer tank 100 to be adjusted by the temperature adjustment unit 22 and then to be degassed by the degassing unit 21. This configuration thus allows the ink with a temperature lowered by the temperature adjustment unit 22 to be degassed even if the ink with a temperature higher than a predetermined temperature is supplied from the buffer tank 100, preventing gas from being dissolved again.

<Ink Temperature Adjustment and Degassing Flow>

Figure 9:
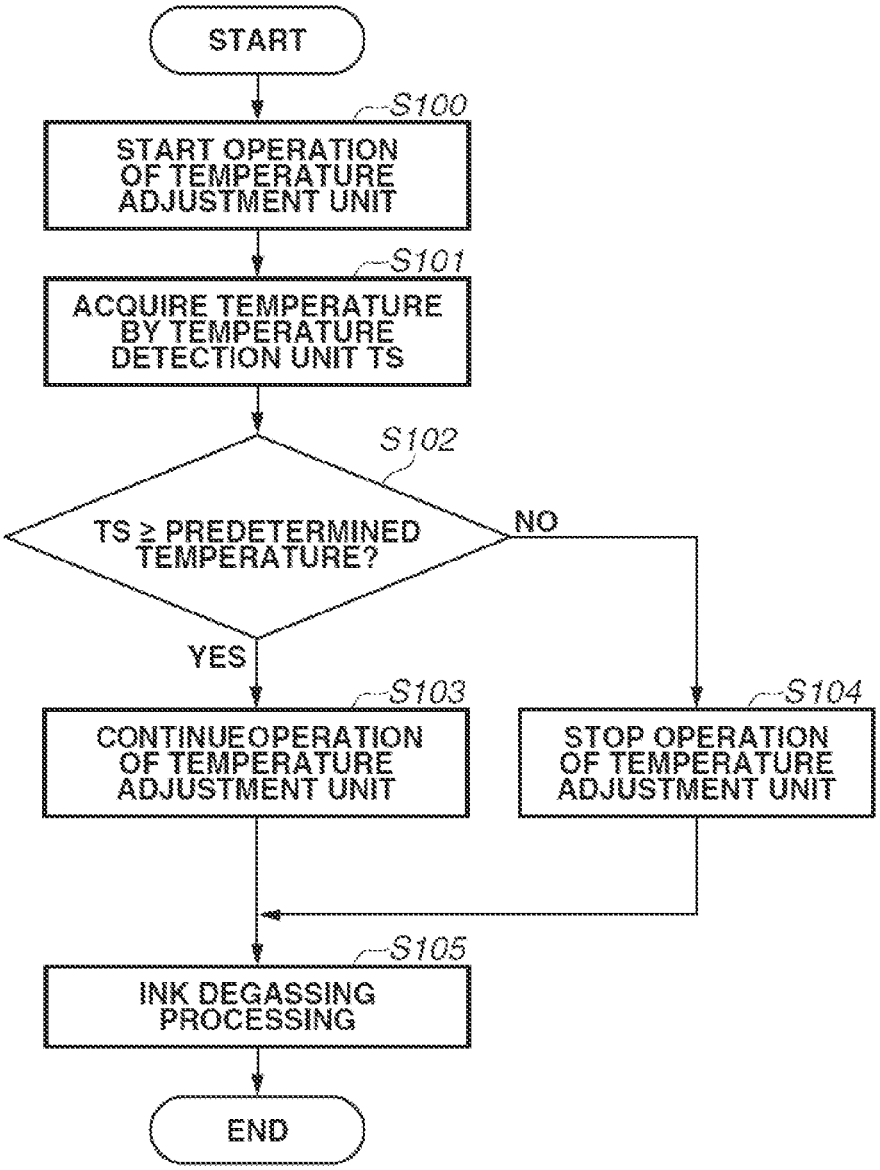
FIG. 9 is a flowchart of control for a temperature adjustment and degassing of ink by the recording apparatus according to the first exemplary embodiment.

FIG. 9 illustrates a flowchart of the control regarding the temperature adjustment and the degassing of the ink. The supply unit 6 is part of the recording apparatus 1A and the IS control unit 16E (FIG. 5) controls the supply unit 6 that includes the temperature adjustment unit 22. The recording apparatus 1A includes a temperature adjustment control unit (such as IS control unit 16E) to control the temperature adjustment unit 22, and the temperature adjustment control unit controls an operation, a stop, and a temperature setting of the temperature adjustment device 24 in the temperature adjustment unit 22.

In step S100, the temperature adjustment control unit starts operation of the temperature adjustment unit 22. After that, in step S101, the temperature detection unit TS acquires information regarding the ink temperature.

In step S102, the recording apparatus 1A determines whether the acquired ink temperature of the ink in the upstream supply flow path C0 from buffer tank 100 is a predetermined temperature or higher. If the acquired ink temperature is the predetermined temperature or higher (YES in step S102), the recording apparatus 1A lowers the temperature of the ink by continuing the operation (driving) of the temperature adjustment unit 22 at step S103. In step S105, the ink with a temperature lowered by the temperature adjustment unit 22 to a predetermined temperature undergoes the degassing processing for removing the gas (dissolved oxygen) dissolved in the ink by the degassing unit 21.

On the other hand, if the ink temperature acquired in step S102 is lower than the predetermined temperature (NO in step S102), in step S104, the recording apparatus 1A stops the operation (the driving) of the temperature adjustment unit 22 to raise the temperature of the ink. Such a situation arises, for example, when the recording apparatus 1A is in use under a low-temperature environment or when low-temperature ink is supplied from the ink tank 110 to the buffer tank 100.

The recording apparatus 1A is configured to raise the temperature of the ink by stopping the temperature adjustment unit 22 in the present exemplary embodiment, but may use a heater for heating the ink in the recording head 30 to a predetermined temperature as a method for heating the ink. The recording element for ejecting the ink for the recording operation may also serve as the heater used as the heating unit.

Other Exemplary Embodiments

The first exemplary embodiment has been described based on the configuration in which the recording unit 3 includes the plurality of recording heads 30, but the recording unit 3 may have a single recording head 30. Further, the recording head 30 may be a serial-type recording head mounted on a movable carriage and configured to carry out recording by discharging ink while moving together with the carriage.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-193823, filed Nov. 20, 2020, which is hereby incorporated by reference herein in its entirety.

What is claimed is:

1. A recording apparatus comprising:

a storage unit configured to store liquid to be supplied to a recording head configured to discharge the liquid;

a supply flow path connecting the storage unit and the recording head;

a temperature adjustment unit configured to receive the liquid from the storage unit and to adjust a temperature of the received liquid; and a degassing unit configured to degas liquid received from the temperature adjustment unit, wherein, on receiving the liquid from the storage unit, the temperature adjustment unit lowers a temperature of the received liquid, and wherein, on receiving the temperature lowered liquid from the temperature adjustment unit, the degassing unit degases the temperature lowered liquid flowing in the supply flow path by removing gas dissolved in the liquid.

2. The recording apparatus according to claim 1, further comprising a temperature detection unit configured to detect the temperature of the liquid flowing into the temperature adjustment unit, wherein, based on detection by the temperature detection unit, the temperature adjustment unit lowers the temperature of the received liquid without degassing the liquid.

3. The recording apparatus according to claim 2, wherein the temperature detection unit is provided between the storage unit and the temperature adjustment unit.

4. The recording apparatus according to claim 3, wherein the temperature adjustment unit is driven to lower the temperature of the liquid in a case where the temperature detected by the temperature detection unit is a predetermined temperature or higher, and is stopped from adjusting the temperature of the liquid in a case where the detected temperature is lower than the predetermined temperature such that the temperature of the liquid increases.

5. The recording apparatus according to claim 1, further comprising a collection flow path configured to collect the liquid from the recording head.

6. The recording apparatus according to claim 5, wherein the liquid is circulated in a circulation flow path that includes the storage unit, the supply flow path, the recording head, and the collection flow path.

7. The recording apparatus according to claim 6, wherein the recording head includes a discharge unit configured to discharge the liquid, and a discharge unit flow path through which the liquid discharged from the discharge unit passes near an opening portion of the discharge unit, and wherein the circulation flow path includes the discharge unit flow path.

8. A method for a recording apparatus having a storage unit configured to store liquid to be supplied to a recording head configured to discharge the liquid, a supply flow path connecting the storage unit and the recording head, temperature adjustment unit, and a degassing unit, the method comprising:

receiving, via the temperature adjustment unit, the liquid from the storage unit and adjusting a temperature of the received liquid; and degassing, via the degassing unit, liquid received from the temperature adjustment unit, wherein, on receiving the liquid from the storage unit, the temperature adjustment unit lowers a temperature of the received liquid, and wherein, on receiving the temperature lowered liquid from the temperature adjustment unit, the degassing unit degases the temperature lowered liquid flowing in the supply flow path by removing gas dissolved in the liquid.

9. The method according to claim 8, further comprising detecting the temperature of the liquid flowing into the temperature adjustment unit, wherein, based on detection by the temperature detection unit, the temperature adjustment unit lowers the temperature of the received liquid without degassing the liquid.

10. The method according to claim 8, further comprising collecting the liquid from the recording head through a collection flow path.

11. The method according to claim 10, wherein the liquid is circulated in a circulation flow path that includes the storage unit, the supply flow path, the recording head, and the collection flow path.

* * * * *